US010092066B2

(12) United States Patent
Lin

(10) Patent No.: US 10,092,066 B2
(45) Date of Patent: Oct. 9, 2018

(54) ZIPPER HEAD ASSEMBLY STRUCTURE AND ELASTIC MEMBER THEREOF

(71) Applicant: CHUNG CHWAN ENTERPRISE CO., LTD., Taoyuan (TW)

(72) Inventor: Yu-Pau Lin, Taoyuan (TW)

(73) Assignee: CHUNG CHWAN ENTERPRISE CO., LTD., Taoyuan (TW)

( * ) Notice: Subject to any disclaimer, the term of this patent is extended or adjusted under 35 U.S.C. 154(b) by 0 days.

(21) Appl. No.: 15/473,122

(22) Filed: Mar. 29, 2017

(65) Prior Publication Data

US 2018/0199678 A1 Jul. 19, 2018

(30) Foreign Application Priority Data

Jan. 18, 2017 (TW) ..... 106101689 A

(51) Int. Cl.
*A44B 19/30* (2006.01)
*A44B 19/26* (2006.01)

(52) U.S. Cl.
CPC ..... *A44B 19/308* (2013.01); *A44B 19/262* (2013.01)

(58) Field of Classification Search
CPC ..... A44B 19/308; A44B 19/262
See application file for complete search history.

(56) References Cited

U.S. PATENT DOCUMENTS 3,793,684 A * 2/1974 Moertel ..... A44B 19/26 24/421
4,081,883 A * 4/1978 Ishii ..... A44B 19/306 24/421
5,544,394 A * 8/1996 Yaguramaki ..... A44B 19/308 24/424
5,809,622 A * 9/1998 Yaguramaki ..... A44B 19/308 24/419
6,314,624 B1 * 11/2001 Lin ..... A44B 19/308 24/421
6,510,594 B2 * 1/2003 Lin ..... A44B 19/308 24/419
7,257,869 B2 * 8/2007 Lin ..... A44B 19/262 24/421

(Continued)

FOREIGN PATENT DOCUMENTS

CN 2402177 Y 10/2000
KR 1997-0000456 Y1 1/1997

(Continued)

*Primary Examiner* — David M Upchurch

(74) *Attorney, Agent, or Firm* — Li & Cai Intellectual Property (USA) Office

(57) ABSTRACT

A zipper head assembly structure includes a sliding assembly and a pulling member. The sliding assembly has a base portion, a seat portion, an elastic member and a retaining member. The elastic member has a first fixing portion fixed on the seat portion, a second fixing portion fixed on the seat portion, an exposed portion connected between the first fixing portion and the second fixing portion and exposed out of the seat portion, an elastic portion extended from the first fixing portion, and an abutting portion extended from the elastic portion for abutting against the retaining member. The retaining member is movably disposed on the seat portion for movably contacting the elastic member. The pulling member is movably mated with the retaining member.

10 Claims, 13 Drawing Sheets

(56) References Cited

U.S. PATENT DOCUMENTS

| | | | | |
|---|---|---|---|---|
| 7,337,510 | B2 * | 3/2008 | Yamagishi | A44B 19/306 24/421 |
| 9,125,459 | B1 * | 9/2015 | Lin | A44B 19/26 |
| 2002/0189057 | A1 * | 12/2002 | Lin | A44B 19/308 24/421 |
| 2007/0169321 | A1 * | 7/2007 | Lin | A44B 19/308 24/421 |
| 2014/0338158 | A1 * | 11/2014 | Lin | A44B 19/26 24/431 |

FOREIGN PATENT DOCUMENTS

| | | | |
|---|---|---|---|
| KR | 1998-0008093 | A | 4/1998 |
| KR | 20-0481440 | Y1 | 9/2016 |
| TW | 200628090 | A | 8/2006 |
| TW | 201238514 | A1 | 10/2012 |
| TW | 201632104 | A | 9/2016 |

* cited by examiner

ZIPPER HEAD ASSEMBLY STRUCTURE AND ELASTIC MEMBER THEREOF

BACKGROUND OF THE INVENTION

1. Field of the Invention

The present disclosure relates to an assembly structure and an elastic member thereof, and more particularly to a zipper head assembly structure and an elastic member thereof 2. Description of Related Art In general, zippers are basic members in clothing or accessories. Compare to buttons, the zippers are easier to use. A conventional zipper includes a zipper head and a tape. The zipper head works with the tape to allow the pulling action. Recently, the zipper has been used commonly for clothing, pants, backpack, and other accessories.

SUMMARY OF THE INVENTION

One aspect of the present disclosure relates to a zipper head assembly structure and an elastic member thereof.

One of the embodiments of the present disclosure provides a zipper head assembly structure, including a sliding assembly and a pulling member. The sliding assembly has a sliding member, an elastic member and a retaining member. The sliding member has a base portion, a first lateral wall portion, a second lateral wall portion and a seat portion. The first lateral wall portion and the second lateral wall portion are respectively upwardly extended from two opposite lateral sides of the base portion. The first lateral wall portion and the second lateral wall portion correspond to each other and are connected to a front side portion of the base portion. The seat portion is disposed on the base portion and is connected to a rear side portion of the base portion. The seat portion has a positioning through hole formed between the first lateral wall portion and the second lateral wall portion. The elastic member is disposed on the seat portion to elastically abut against the retaining member. The elastic member has a first fixing portion fixed on the seat portion, a second fixing portion fixed on the seat portion, an exposed portion connected between the first fixing portion and the second fixing portion and exposed out of the seat portion, an elastic portion extended from the first fixing portion, and an abutting portion extended from the elastic portion for abutting against the retaining member. The retaining member is movably disposed on the seat portion for movably contacting the elastic member, and the retaining member has a positioning portion disposed on an end thereof for passing through the positioning through hole. The pulling member is movably mated with the retaining member.

Another one of the embodiments of the present disclosure provides an elastic member disposed on a seat portion of a sliding member of a sliding assembly for elastically abutting against a retaining member that is movably disposed on the seat portion. The elastic member includes a first fixing portion fixed on the seat portion, a second fixing portion fixed on the seat portion, an exposed portion connected between the first fixing portion and the second fixing portion and exposed out of the seat portion, an elastic portion extended from the first fixing portion, and an abutting portion extended from the elastic portion for abutting against the retaining member.

Yet another one of the embodiments of the present disclosure provides a zipper head assembly structure, including a sliding assembly and a pulling member. The sliding assembly has a sliding member, an elastic member and a retaining member. The sliding member has a base portion and a seat portion, the seat portion is disposed on the base portion. The seat portion has a positioning through hole. The elastic member has a first fixing portion fixed on the seat portion, a second fixing portion fixed on the seat portion, an exposed portion connected between the first fixing portion and the second fixing portion and exposed out of the seat portion, an elastic portion extended from the first fixing portion, and an abutting portion extended from the elastic portion for abutting against the retaining member. The retaining member is movably disposed on the seat portion for movably contacting the elastic member, and the retaining member has a positioning portion disposed on an end thereof for passing through the positioning through hole. The pulling member is movably mated with the retaining member.

Therefore, the first fixing portion and the second fixing portion of the elastic member are fixed on the seat portion, so that the bonding strength between the elastic member and seat portion can be increased so as to prevent the pulling member from being separated from the sliding assembly.

To further understand the techniques, means and effects of the present disclosure applied for achieving the prescribed objectives, the following detailed descriptions and appended drawings are hereby referred to, such that, and through which, the purposes, features and aspects of the present disclosure can be thoroughly and concretely appreciated. However, the appended drawings are provided solely for reference and illustration, without any intention to limit the present disclosure.

DETAILED DESCRIPTION OF THE PREFERRED EMBODIMENTS

Figure 1:
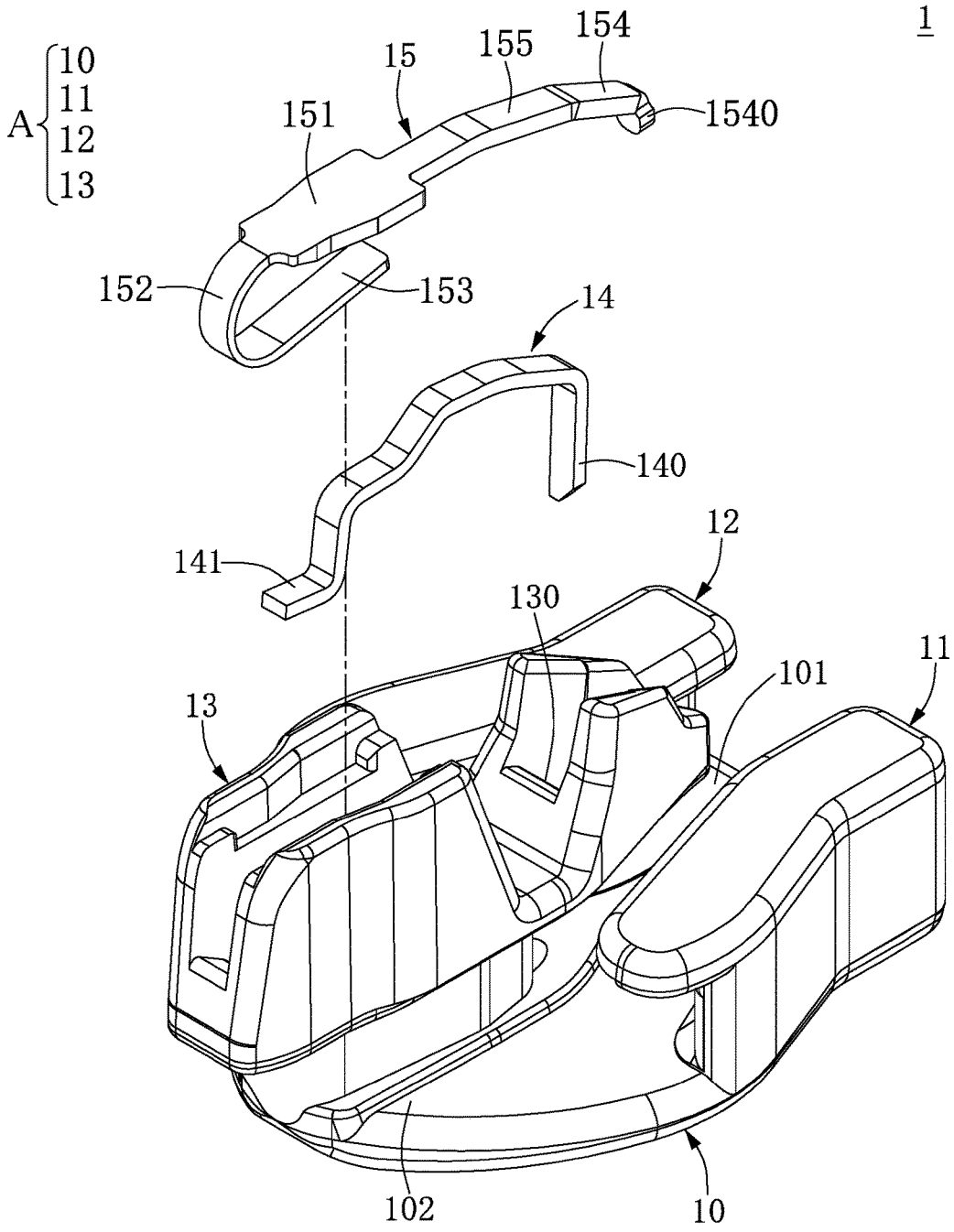
FIG. 1 shows an exploded perspective schematic view of a sliding assembly (an elastic member has not be retained by a base portion yet) according to the present disclosure.

The embodiments of a zipper head assembly structure and an elastic member thereof of the present disclosure are described. Other advantages and objectives of the present disclosure can be easily understood by one skilled in the art from the disclosure. The present disclosure can be applied in different embodiments. Various modifications and variations can be made to various details in the description for different applications without departing from the scope of the present disclosure. The drawings of the present disclosure are provided only for simple illustrations, but are not drawn to scale and do not reflect the actual relative dimensions. The following embodiments are provided to describe in detail the concept of the present disclosure, and are not intended to limit the scope thereof in any way.

Referring to FIG. 1 to FIG. 8, one of embodiments of the present disclosure provides a sliding assembly 1 (such as a sliding head or a slide fastener head), and the sliding assembly 1 includes a base portion 10, a first lateral wall portion 11, a second lateral wall portion 12, a seat portion 13, a retaining member 14 (such as a hook body or a horse-like hook), and an elastic member 15. The base portion 10, the first lateral wall portion 11, the second lateral wall portion 12 and the seat portion 13 are mated with each other to form a sliding member A.

Figure 6:
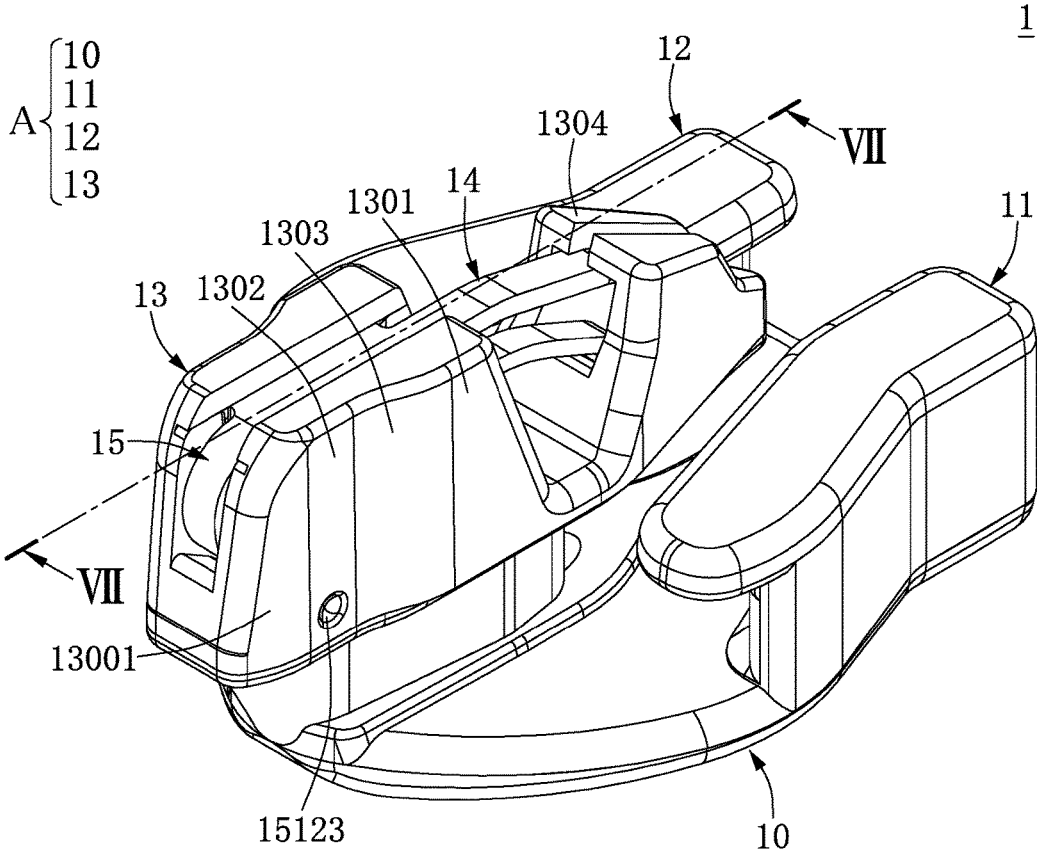
FIG. 6 shows an assembled perspective schematic view of the sliding assembly (the elastic member has be retained by the top portion of the base portion) according to the present disclosure.
Figure 7:
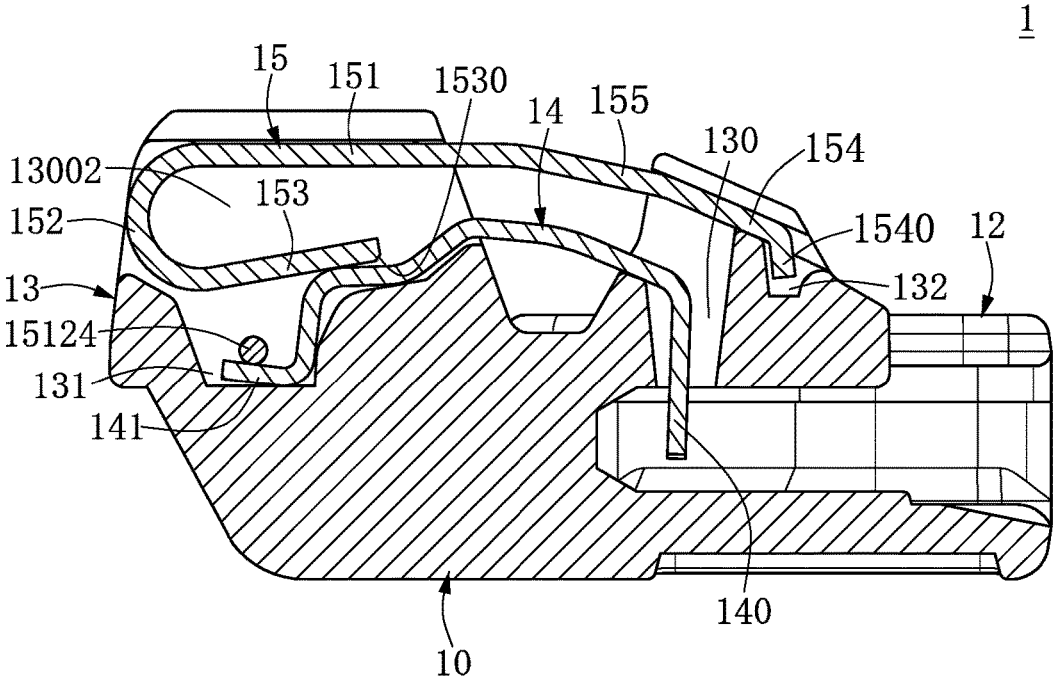
FIG. 7 shows a cross-sectional view taken along the section line VII-VII of FIG. 6.

Referring to FIG. 1, FIG. 6 and FIG. 7, the first lateral wall portion 11 and the second lateral wall portion 12 are respectively upwardly extended from two opposite lateral sides of the base portion 10, and the first lateral wall portion 11 and the second lateral wall portion 12 correspond to each other and are connected to a front side portion 101 of the base portion 10. In addition, the seat portion 13 is disposed on the base portion 10 and is connected to a rear side portion 102 of the base portion 10, and the seat portion 13 has a positioning through hole 130 formed between the first lateral wall portion 11 and the second lateral wall portion 12. Moreover, the elastic member 15 is disposed on the seat portion 13 to elastically abut against the retaining member 14, and the elastic member 15 has a first fixing portion 151 fixed on the seat portion 13, a second fixing portion 154 fixed on the seat portion 13, an exposed portion 155 connected between the first fixing portion 151 and the second fixing portion 154 and exposed out of the seat portion 13 (or exposed from the seat portion 13), an elastic portion 152 extended from the first fixing portion 151, and an abutting portion 153 extended from the elastic portion 152 for abutting against the retaining member 14. Furthermore, the retaining member 14 is movably disposed on the seat portion 13 for movably contacting the abutting portion 153 of the elastic member 15, and the retaining member 14 has a positioning portion 140 disposed on an end portion thereof for passing through the positioning through hole 130.

Figure 3:
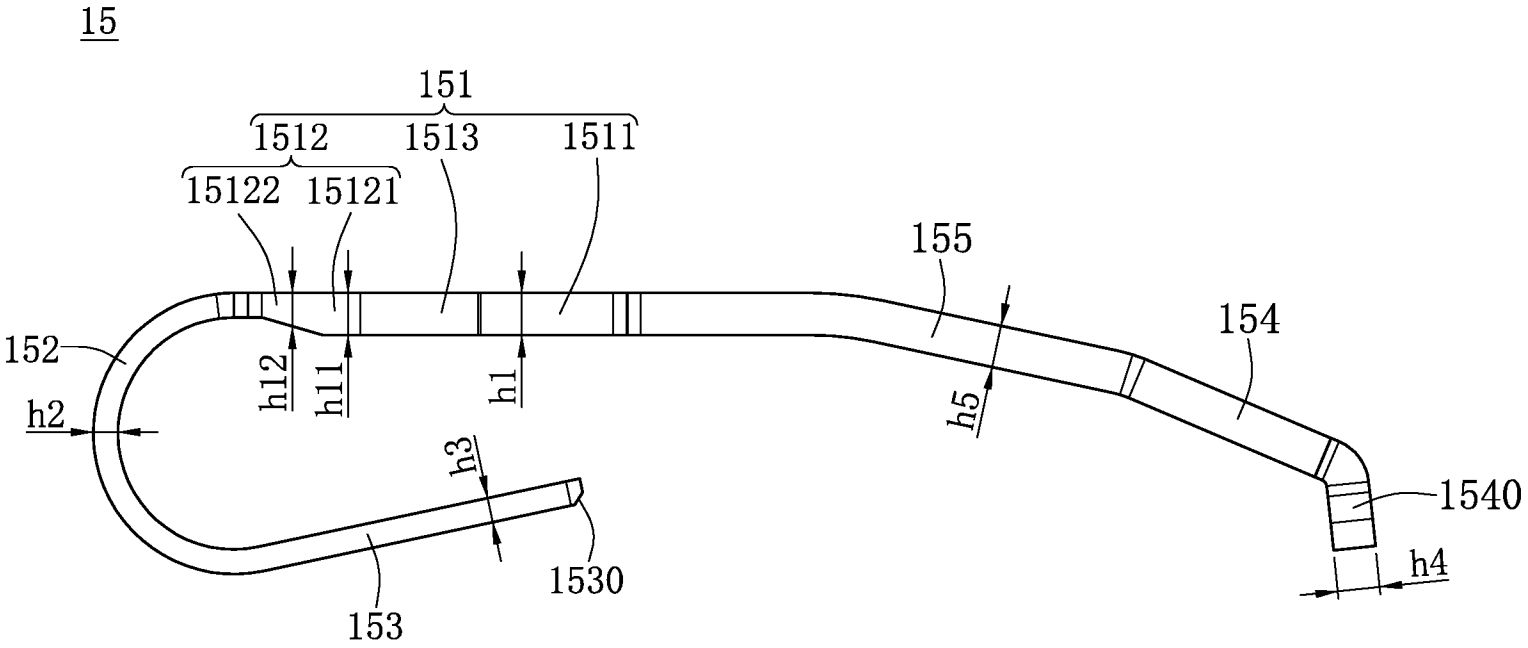
FIG. 3 shows a lateral schematic view of an elastic member of the sliding assembly according to the present disclosure.
Figure 8:
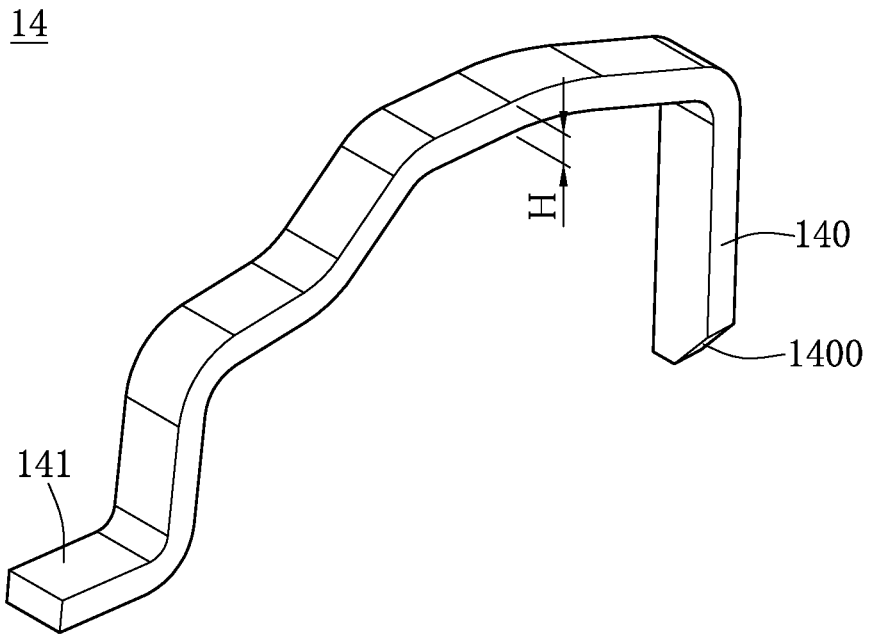
FIG. 8 shows a perspective schematic view of a retaining member of the sliding assembly according to the present disclosure.

It should be noted that a thickness h2 of the elastic portion 152 is smaller than a thickness h1 of the first fixing portion 151 as shown in FIG. 3, such that an elastic coefficient and an elastic force provided by the elastic portion 152 can be increased. Therefore, the elastic portion 152 can avoid causing elastic fatigue and plastic deformation so as to increase the usage life of the elastic member 15. In addition, the thickness h1 of the first fixing portion 151, a thickness h4 of the second fixing portion 154, and a thickness h5 of the exposed portion are substantially the same, and the abutting portion 153 has an inclined chamfer 1530 formed on an end thereof. It should be noted that the retaining member 14 has a uniform thickness H, and the positioning portion 140 of the retaining member 14 has a cutting edge 1400 (such as a cutting plane) formed on a lateral surface thereof as shown in FIG. 8.

Figure 4:
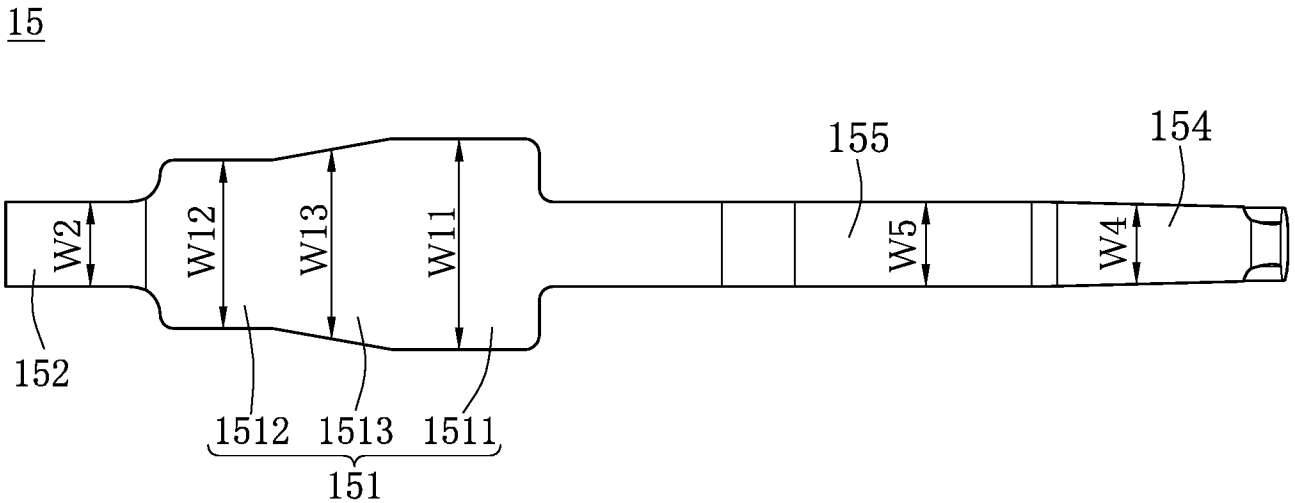
FIG. 4 shows a top schematic view of the elastic member of the sliding assembly according to the present disclosure.
Figure 5:
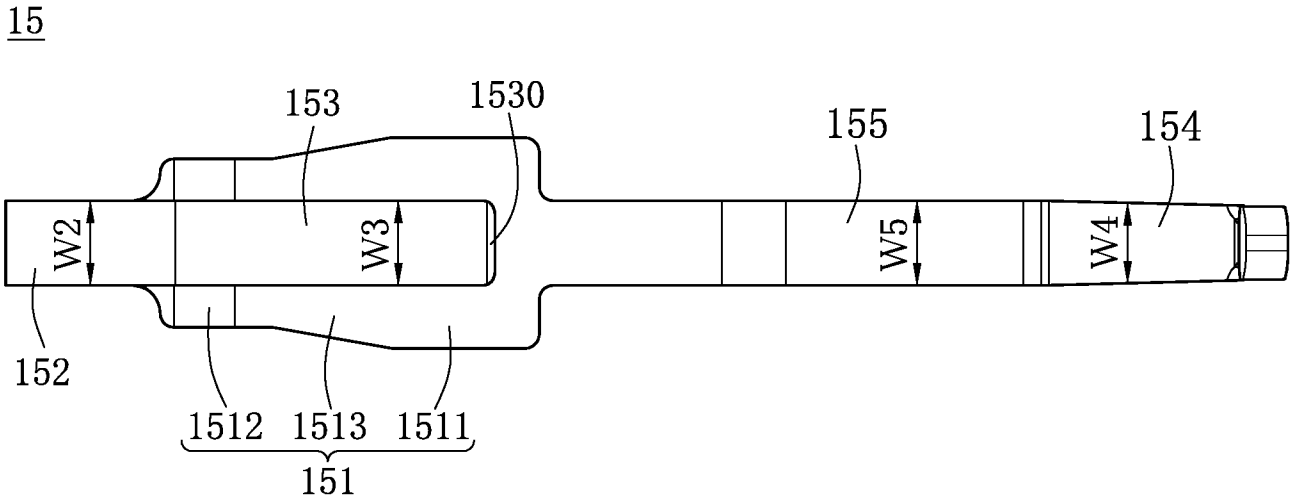
FIG. 5 shows a bottom schematic view of the elastic member of the sliding assembly according to the present disclosure.

More particularly, referring to FIG. 1, FIG. 4 and FIG. 5, the first fixing portion 151 has a front fixing section 1511, a rear fixing section 1512 connected to the elastic portion 152, and a middle fixing section 1513 connected between the front fixing section 1511 and the rear fixing section 1512. With regard to a width of the elastic member 15, as shown in FIG. 4, a width W12 of the rear fixing section 1512 is smaller than a width W11 of the front fixing section 1511, and a width W13 of the middle fixing section 1513 is decreased gradually from the front fixing section 1511 to the rear fixing section 1512. As shown in FIG. 5, a width W2 of the elastic portion 152 is much smaller than the width W12 of the rear fixing section 1512, such that an elastic coefficient and an elastic force provided by the elastic portion 152 can be increased. Therefore, the elastic portion 152 can avoid causing elastic fatigue and plastic deformation so as to increase the usage life of the elastic member 15. In addition, as shown in FIG. 5, a width W3 of the abutting portion 153 is larger than or substantially equal to a width W2 of the elastic portion 152. When the width W3 of the abutting portion 153 is larger than the width W2 of the elastic portion 152, a contact area between the elastic member 15 and the retaining member 14 is increased. It should be noted that the width W3 of the abutting portion 153 and a width W 5 of the exposed portion 155 are substantially the same, and a width W 4 of the second fixing portion 154 is a as shown in FIG. 4 and FIG. 5.

More particularly, referring to FIG. 1 and FIG. 3, the rear fixing section 1512 has a first fixing section 15121 connected to the middle fixing section 1513 and a second fixing section 15122 connected between the first fixing section 15121 and the elastic portion 152. With regard to a thickness of the elastic member 15, as shown in FIG. 3, a thickness h2 of the elastic portion 152 is smaller than a thickness h11 of the first fixing section 15121 and a thickness h12 of the second fixing section 15122 of the rear fixing section 1512, and the thickness h12 of the second fixing section 15122 is decreased gradually from the first fixing section 15121 to the elastic portion 152. In addition, a thickness h2 of the elastic portion 152 and a thickness h3 of the abutting portion 153 are substantially the same.

Figure 2:
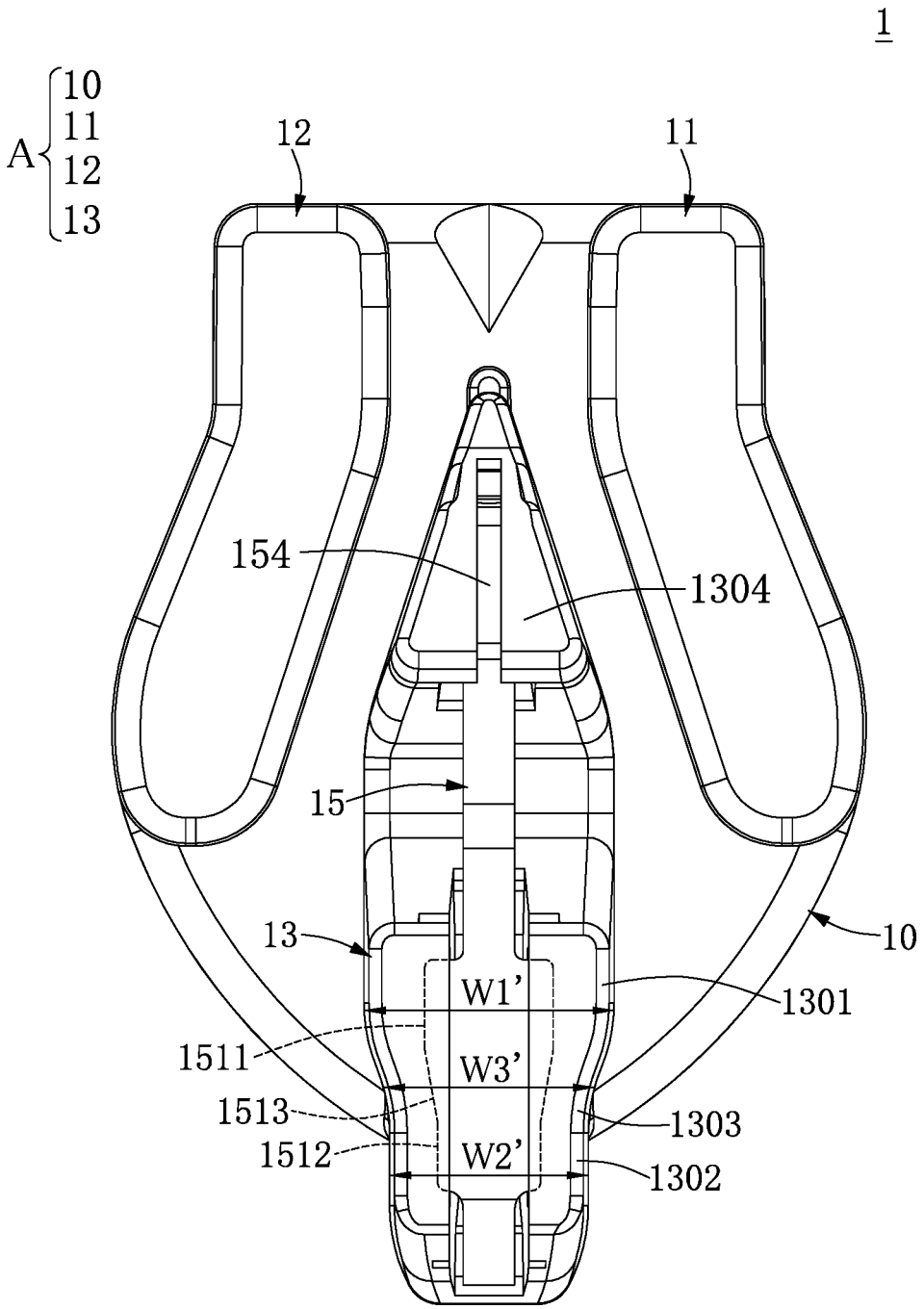
FIG. 2 shows an assembly schematic view of the sliding assembly (the elastic member has be retained by a top portion of the base portion) according to the present disclosure.

More particularly, referring to FIG. 1, FIG. 2 and FIG. 6, the seat portion 13 has a front retaining section 1301 for fixing the front fixing section 1511, a rear retaining section 1302 for fixing the rear fixing section 1512, and a middle retaining section 1303 connected between the front retaining section 1301 and the rear retaining section 1302 for fixing the middle fixing section 1513. In addition, as shown in FIG. 2, a width W2' of the rear retaining section 1302 is smaller than a width Wr of the front retaining section 1301, and a width W3' of the middle retaining section 1303 is decreased gradually from the front retaining section 1301 to the rear retaining section 1302. The width W3' of the middle retaining section 1303 and the width W2' of the rear retaining section 1302 are smaller than the width W1' of the front retaining section 1301, so that the friction force between the seat portion 13 and a clothing can be decreased so as to increase the smooth level of the sliding assembly 1 slidably mated with the clothing It should be noted that the seat portion 13 has an auxiliary retaining section 1304 separated from the front retaining section 1301 for fixing the second fixing portion 154 as shown in FIG. 2 and FIG. 6.

Figure 10:
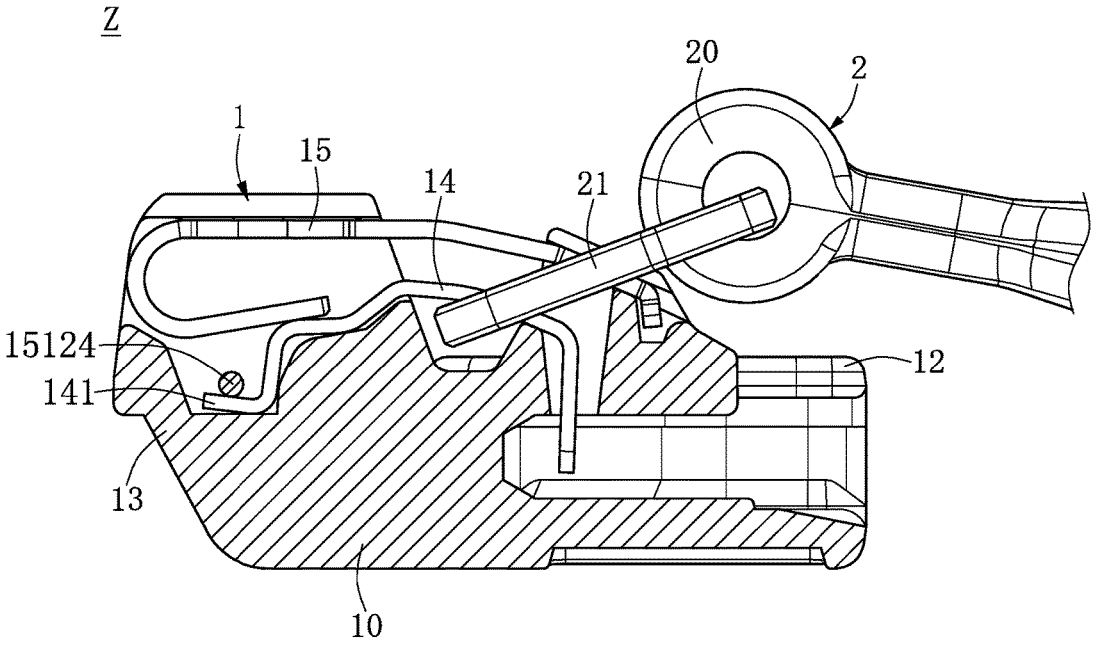
FIG. 10 shows a partial cross-sectional schematic view of the zipper head assembly structure before upwardly pulling the retaining member by a pulling member according to the present disclosure.
Figure 11:
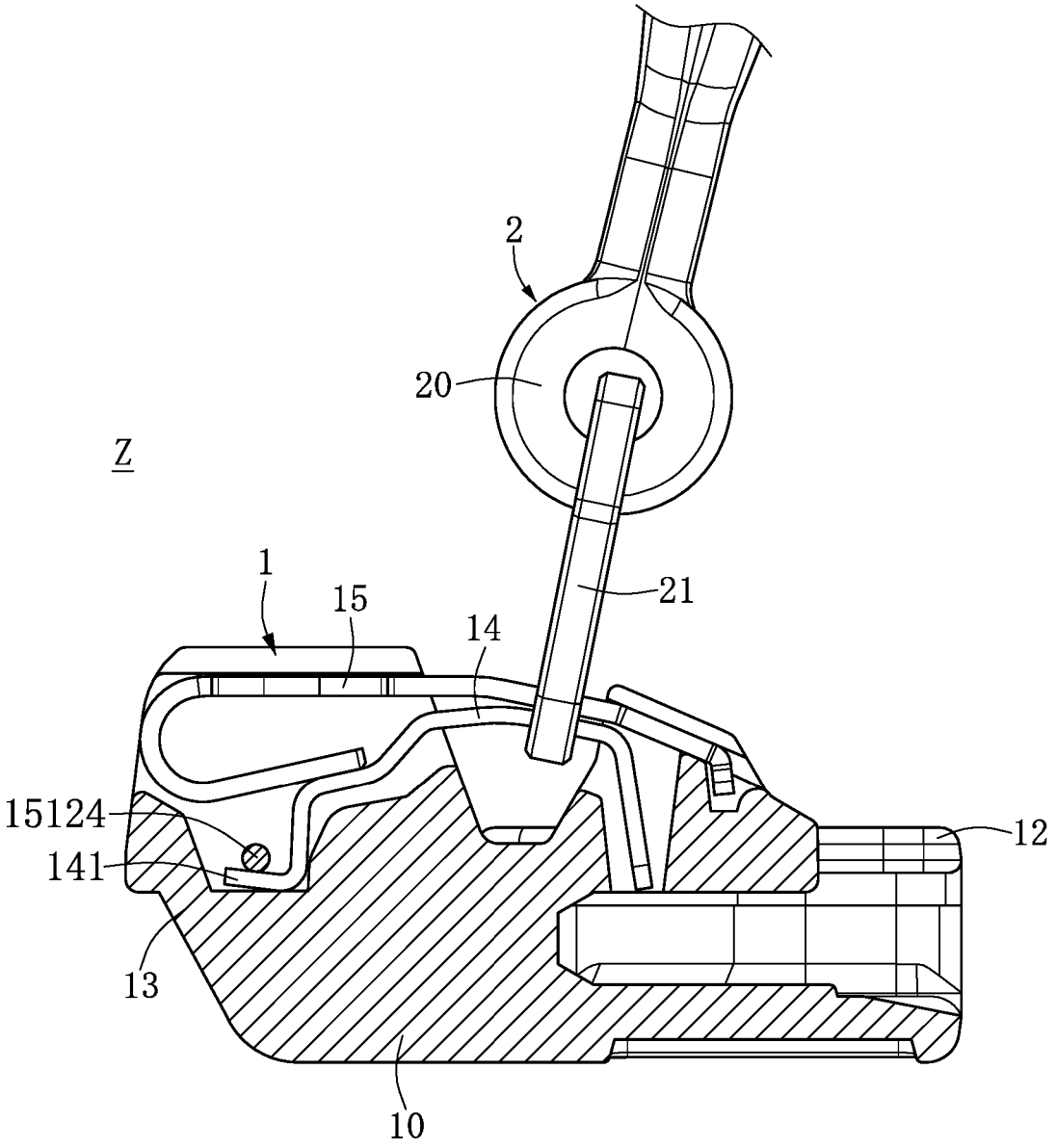
FIG. 11 shows a partial cross-sectional schematic view of the zipper head assembly structure after upwardly pulling the retaining member by the pulling member according to the present disclosure.

More particularly, referring to FIG. 1, FIG. 6 and FIG. 7, the seat portion 13 has at least one concave space 15123 concaved on an outer surface 13001 thereof, and the seat portion 13 has at least one protruding body 15124 disposed on an inner surface 13002 thereof and adjacent and corresponding to the at least one concave space 15123, and the at least one concave space 15123 and the at least one protruding body 15124 are disposed on the rear retaining section 1302 of the seat portion 13. It should be noted that the seat portion 13 has a first receiving groove 131 and a second receiving groove 132 as shown in FIG. 7, and the retaining member 14 has a retaining portion 141 disposed on another end thereof and retained inside the first received groove 131 by the at least one protruding body 15124. That is to say, the at least one protruding body 15124 can keep the retaining portion 141 to be disposed and retained inside a first receiving groove 131 of the seat portion 13 as shown in FIG. 7, so that the retaining member 14 can be moved upwardly (as shown in FIG. 11) or downwardly (as shown in FIG. 10) relative to the retaining portion 141 as a rotating shaft or a rotation axis. In addition, the second fixing portion 154 has a retaining body 1540 retained inside the second received groove 132.

Referring to FIG. 9 to FIG. 12, one of embodiments of the present disclosure provides a zipper head assembly structure Z disposed on a zipper teeth structure 3 (such as a zipper tape or a zipper strip) including a first zipper teeth member 31 (such as a zipper rack or a toothed bar) and a second zipper teeth member 32 mated with each other. The zipper head assembly structure Z includes a sliding assembly 1 and a pulling member 2 (such as a pull tab or a pull piece).

Figure 9:
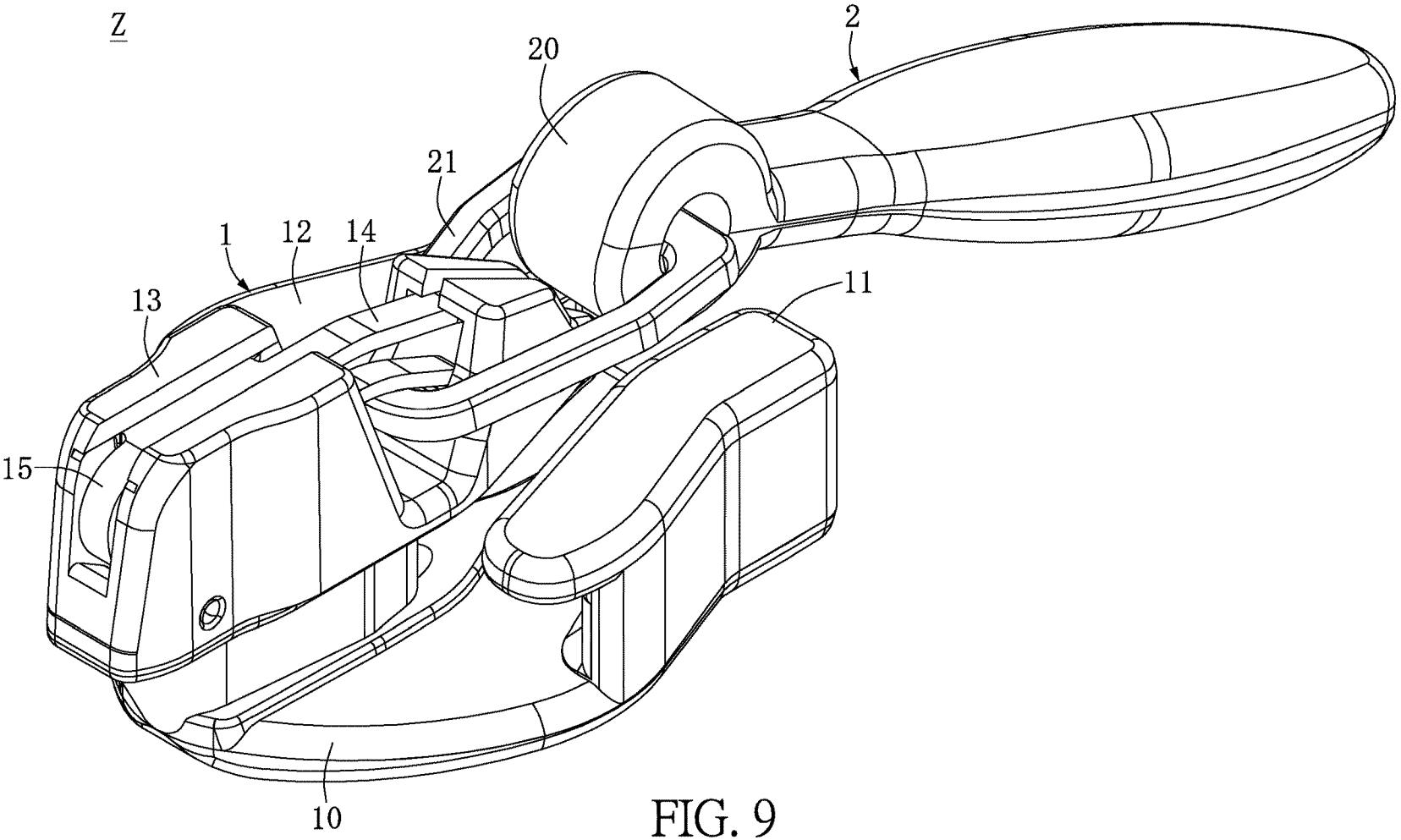
FIG. 9 shows a perspective schematic view of a zipper head assembly structure according to the present disclosure.
Figure 12:
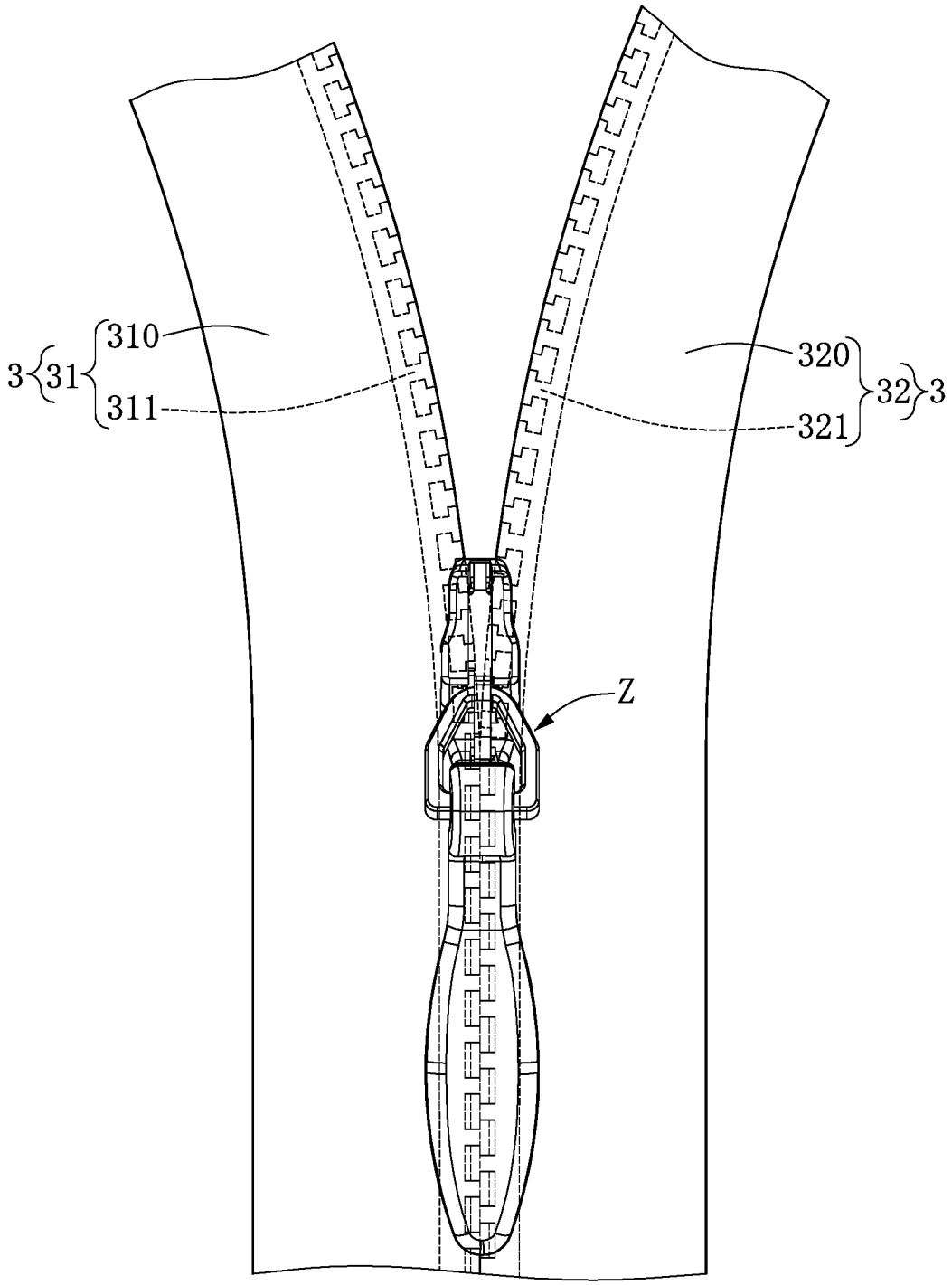
FIG. 12 shows a top schematic view of the zipper head assembly structure slidably disposed on a zipper teeth structure according to the present disclosure.

Referring to FIG. 1, FIG. 9 and FIG. 12, the sliding assembly 1 includes a base portion 10, a first lateral wall portion 11, a second lateral wall portion 12, a seat portion 13, a retaining member 14 and an elastic member 15. The first lateral wall portion 11 and the second lateral wall portion 12 are respectively upwardly extended from two opposite lateral sides of the base portion 10, and the first lateral wall portion 11 and the second lateral wall portion 12 correspond to each other and are connected to a front side portion 101 of the base portion 10. In addition, the seat portion 13 is disposed on the base portion 10 and is connected to a rear side portion 102 of the base portion 10, and the seat portion 13 has a positioning through hole 130 formed between the first lateral wall portion 11 and the second lateral wall portion 12. Moreover, the elastic member 15 is disposed on the seat portion 13 to elastically abut against the retaining member 14, and the elastic member 15 has a first fixing portion 151 fixed on the seat portion 13, a second fixing portion 154 fixed on the seat portion 13, an exposed portion 155 connected between the first fixing portion 151 and the second fixing portion 154 and exposed out of the seat portion 13, an elastic portion 152 extended from the first fixing portion 151, and an abutting portion 153 extended from the elastic portion 152 for abutting against the retaining member 14. Furthermore, the retaining member 14 is movably disposed on the seat portion 13 for movably contacting the abutting portion 153 of the elastic member 15, and the retaining member 14 has a positioning portion 140 disposed on an end portion thereof for passing through the positioning through hole 130. In addition, the pulling member 2 is movably mated with the retaining member 14, for example, the pulling member 2 includes a movable piece 21 disposed on an end portion 20 thereof for movably mating with the retaining member 14.

Figure 13:
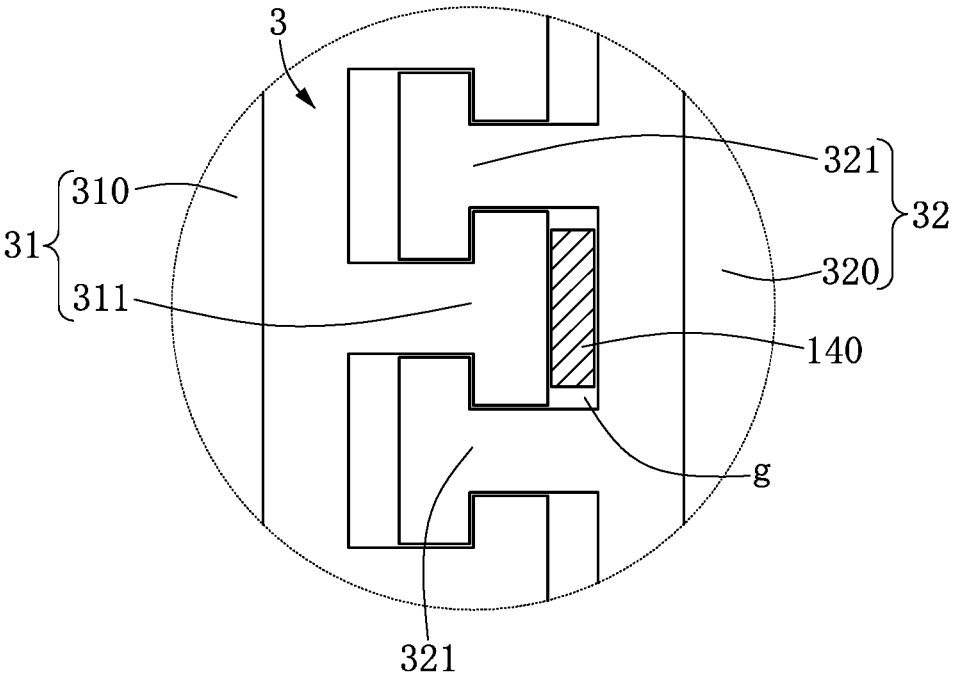
FIG. 13 shows an enlarged schematic view of a positioning portion inserted into a gap between two adjacent second zipper teeth.

More particularly, referring to FIG. 12 and FIG. 13, the first zipper teeth member 31 includes a first zipper teeth carrier 310 and a plurality of first zipper teeth 311 disposed on the first zipper teeth carrier 310, and the second zipper teeth member 32 includes a second zipper teeth carrier 320 and a plurality of second zipper teeth 321 disposed on the second zipper teeth carrier 320. In addition, as shown in FIG. 13, each of the first zipper teeth 311 can be retained between two adjacent second zipper teeth 321. When one of the first zipper teeth 311 is retained between two of the second zipper teeth 321 to form a gap P between the first zipper tooth 311 and the two second zipper teeth 321 for receiving the positioning portion 140 (i.e., the positioning portion 140 is inserted into the gap (g) between the two adjacent second zipper teeth 321), the zipper head assembly structure Z can be accurately positioned on the zipper teeth structure 3 by matching the positioning portion 140 and the gap (g).

In conclusion, the first fixing portion 151 and the second fixing portion 154 of the elastic member 15 are fixed on the seat portion 13, so that the bonding strength between the elastic member 15 and seat portion 13 can be increased so as to prevent the pulling member 2 from being separated from the sliding assembly 1.

Moreover, the elastic coefficient and the elastic force provided by the elastic portion 152 can be increased by matching "the elastic member 15 having a first fixing portion 151 fixed on the seat portion 13, an elastic portion 152 extended from the first fixing portion 151, and an abutting portion 153 extended from the elastic portion 152 for abutting against the retaining member 14" and "the thickness h2 of the elastic portion 152 being smaller than the thickness h1 of the first fixing portion 151". Therefore, the elastic portion 152 can avoid causing elastic fatigue and plastic deformation, so that the usage life of the elastic member 15 can be increased.

Furthermore, the at least one protruding body 15124 can keep the retaining portion 141 to be disposed and retained inside a receiving groove 131 of the seat portion 13 by matching "the seat portion 13 having at least one concave space 15123 concaved on an outer surface 13001 thereof, and the seat portion 13 has at least one protruding body 15124 disposed on an inner surface 13002 thereof and adjacent and corresponding to the at least one concave space 15123" and "the retaining member 14 having a retaining portion 141 disposed on another end thereof and disposed inside a first receiving groove 131 of the seat portion 13", so that the retaining member 14 can be moved upwardly or downwardly relative to the retaining portion 141 as a rotating shaft or a rotation axis.

The aforementioned descriptions merely represent the preferred embodiments of the present disclosure, without any intention to limit the scope of the present disclosure which is fully described only within the following claims. Various equivalent changes, alterations or modifications based on the claims of the present disclosure are all, consequently, viewed as being embraced by the scope of the present disclosure.

What is claimed is:

1. A zipper head assembly structure, comprising:

a sliding assembly having a sliding member, an elastic member and a retaining member, the sliding member having a base portion, a first lateral wall portion, a second lateral wall portion and a seat portion, wherein the first lateral wall portion and the second lateral wall portion are respectively upwardly extended from two opposite lateral sides of the base portion, the first lateral wall portion and the second lateral wall portion correspond to each other and are connected to a front side portion of the base portion, the seat portion is disposed on the base portion and is connected to a rear side portion of the base portion, the seat portion has a positioning through hole formed between the first lateral wall portion and the second lateral wall portion, the elastic member is disposed on the seat portion to elastically abut against the retaining member, the elastic member has a first fixing portion fixed on the seat portion, a second fixing portion fixed on the seat portion, an exposed portion connected between the first fixing portion and the second fixing portion and exposed out of the seat portion, an elastic portion extended from the first fixing portion, and an abutting portion extended from the elastic portion for abutting against the retaining member, the retaining member is movably disposed on the seat portion for movably contacting the elastic member, and the retaining member has a positioning portion disposed on an end thereof for passing through the positioning through hole; and a pulling member movably mated with the retaining member, wherein the elastic member and the retaining member pass through a through hole disposed on an end portion of the pulling member.

2. The zipper head assembly structure of claims 1, wherein a thickness of the elastic portion is smaller than a thickness of the first fixing portion for increasing an elastic coefficient provided by the elastic portion, wherein the first fixing portion has a front fixing section, a rear fixing section connected to the elastic portion, and a middle fixing section connected between the front fixing section and the rear fixing section, a width of the rear fixing section is smaller than a width of the front fixing section, and a width of the middle fixing section is decreased gradually from the front fixing section to the rear fixing section, wherein the rear fixing section has a first fixing section connected to the middle fixing section and a second fixing section connected between the first fixing section and the elastic portion, the thickness of the elastic portion is smaller than a thickness of the first fixing section and a thickness of the second fixing section of the rear fixing section, and the thickness of the second fixing section is decreased gradually from the first fixing section to the elastic portion, wherein the thickness of the first fixing portion, a thickness of the second fixing portion, and a thickness of the exposed portion are substantially the same, the thickness of the elastic portion and a thickness of the abutting portion are substantially the same, a width of the abutting portion is larger than or substantially equal to a width of the elastic portion, and the retaining member has a uniform thickness.

3. The zipper head assembly structure of claims 1, wherein the fixing portion has a front fixing section, a rear fixing section connected to the elastic portion, and a middle fixing section connected between the front fixing section and the rear fixing section, a width of the rear fixing section is smaller than a width of the front fixing section, and a width of the middle fixing section is decreased gradually from the front fixing section to the rear fixing section, wherein the seat portion has a front retaining section for fixing the front fixing section, a rear retaining section for fixing the rear fixing section, a middle retaining section connected between the front retaining section and the rear retaining section for fixing the middle fixing section, and an auxiliary retaining section separated from the front retaining section for fixing the second fixing portion, a width of the rear retaining section is smaller than a width of the front retaining section, and a width of the middle retaining section is decreased gradually from the front retaining section to the rear retaining section, wherein the seat portion has at least one concave space concaved on an outer surface thereof, the seat portion has at least one protruding body disposed on an inner surface thereof and adjacent and corresponding to the at least one concave space, and the at least one concave space and the at least one protruding body are disposed on the rear retaining section of the seat portion, wherein the seat portion has a first receiving groove and a second receiving groove, the retaining member has a retaining portion disposed on another end thereof and retained inside the first received groove by the protruding body, and the second fixing portion has a retaining body positioned inside the second receiving groove.

4. An elastic member disposed on a seat portion of a sliding member of a sliding assembly for elastically abutting against a retaining member that is movably disposed on the seat portion, wherein the elastic member comprises:

a first fixing portion fixed on the seat portion;

a second fixing portion fixed on the seat portion;

an exposed portion connected between the first fixing portion and the second fixing portion and exposed out of the seat portion;

an elastic portion extended from the first fixing portion;

an abutting portion extended from the elastic portion for abutting against the retaining member, wherein the elastic member and the retaining member pass through a through hole disposed on an end portion of a pulling member.

5. The elastic member of claims 4, wherein a thickness of the elastic portion is smaller than a thickness of the first fixing portion for increasing an elastic coefficient provided by the elastic portion, wherein the first fixing portion has a front fixing section, a rear fixing section connected to the elastic portion, and a middle fixing section connected between the front fixing section and the rear fixing section, a width of the rear fixing section is smaller than a width of the front fixing section, and a width of the middle fixing section is decreased gradually from the front fixing section to the rear fixing section, wherein the rear fixing section has a first fixing section connected to the middle fixing section and a second fixing section connected between the first fixing section and the elastic portion, the thickness of the elastic portion is smaller than a thickness of the first fixing section and a thickness of the second fixing section of the rear fixing section, and the thickness of the second fixing section is decreased gradually from the first fixing section to the elastic portion, wherein the thickness of the first fixing portion, a thickness of the second fixing portion, and a thickness of the exposed portion are substantially the same, the thickness of the elastic portion and a thickness of the abutting portion are substantially the same, a width of the abutting portion is larger than or substantially equal to a width of the elastic portion, and the retaining member has a uniform thickness.

6. The elastic member of claims 4, wherein the fixing portion has a front fixing section, a rear fixing section connected to the elastic portion, and a middle fixing section connected between the front fixing section and the rear fixing section, a width of the rear fixing section is smaller than a width of the front fixing section, and a width of the middle fixing section is decreased gradually from the front fixing section to the rear fixing section, wherein the seat portion has a front retaining section for fixing the front fixing section, a rear retaining section for fixing the rear fixing section, a middle retaining section connected between the front retaining section and the rear retaining section for fixing the middle fixing section, and an auxiliary retaining section separated from the front retaining section for fixing the second fixing portion, a width of the rear retaining section is smaller than a width of the front retaining section, and a width of the middle retaining section is decreased gradually from the front retaining section to the rear retaining section, wherein the seat portion has at least one concave space concaved on an outer surface thereof, the seat portion has at least one protruding body disposed on an inner surface thereof and adjacent and corresponding to the at least one concave space, and the at least one concave space and the at least one protruding body are disposed on the rear retaining section of the seat portion, wherein the seat portion has a first receiving groove and a second receiving groove, the retaining member has a retaining portion disposed on another end thereof and retained inside the first received groove by the protruding body, and the second fixing portion has a retaining body positioned inside the second receiving groove.

7. A zipper head assembly structure, comprising:

a sliding assembly having a sliding member, an elastic member and a retaining member, wherein the sliding member has a base portion and a seat portion, the seat portion is disposed on the base portion, the seat portion has a positioning through hole, the elastic member has a first fixing portion fixed on the seat portion, a second fixing portion fixed on the seat portion, an exposed portion connected between the first fixing portion and the second fixing portion and exposed out of the seat portion, an elastic portion extended from the first fixing portion, and an abutting portion extended from the elastic portion for abutting against the retaining member, the retaining member is movably disposed on the seat portion for movably contacting the elastic member, and the retaining member has a positioning portion disposed on an end thereof for passing through the positioning through hole; and a pulling member movably mated with the retaining member, wherein the elastic member and the retaining member pass through a through hole disposed on an end portion of the pulling member.

8. The zipper head assembly structure of claims 7, wherein a thickness of the elastic portion is smaller than a thickness of the first fixing portion for increasing an elastic coefficient provided by the elastic portion, wherein the first fixing portion has a front fixing section, a rear fixing section connected to the elastic portion, and a middle fixing section connected between the front fixing section and the rear fixing section, a width of the rear fixing section is smaller than a width of the front fixing section, and a width of the middle fixing section is decreased gradually from the front fixing section to the rear fixing section, wherein the rear fixing section has a first fixing section connected to the middle fixing section and a second fixing section connected between the first fixing section and the elastic portion, the thickness of the elastic portion is smaller than a thickness of the first fixing section and a thickness of the second fixing section of the rear fixing section, and the thickness of the second fixing section is decreased gradually from the first fixing section to the elastic portion, wherein the thickness of the first fixing portion, a thickness of the second fixing portion, and a thickness of the exposed portion are substantially the same, the thickness of the elastic portion and a thickness of the abutting portion are substantially the same, a width of the abutting portion is larger than or substantially equal to a width of the elastic portion, and the retaining member has a uniform thickness.

9. The zipper head assembly structure of claims 7, wherein the fixing portion has a front fixing section, a rear fixing section connected to the elastic portion, and a middle fixing section connected between the front fixing section and the rear fixing section, a width of the rear fixing section is smaller than a width of the front fixing section, and a width of the middle fixing section is decreased gradually from the front fixing section to the rear fixing section, wherein the seat portion has a front retaining section for fixing the front fixing section, a rear retaining section for fixing the rear fixing section, a middle retaining section connected between the front retaining section and the rear retaining section for fixing the middle fixing section, and an auxiliary retaining section separated from the front retaining section for fixing the second fixing portion, a width of the rear retaining section is smaller than a width of the front retaining section, and a width of the middle retaining section is decreased gradually from the front retaining section to the rear retaining section, wherein the seat portion has at least one concave space concaved on an outer surface thereof, the seat portion has at least one protruding body disposed on an inner surface thereof and adjacent and corresponding to the at least one concave space, and the at least one concave space and the at least one protruding body are disposed on the rear retaining section of the seat portion, wherein the seat portion has a first receiving groove and a second receiving groove, the retaining member has a retaining portion disposed on another end thereof and retained inside the first received groove by the protruding body, and the second fixing portion has a retaining body positioned inside the second receiving groove.

10. The zipper head assembly structure of claims 7, wherein the zipper head assembly structure is disposed on a zipper teeth structure including a first zipper teeth member and a second zipper teeth member mated with each other, the first zipper teeth member includes a first zipper teeth carrier and a plurality of first zipper teeth disposed on the first zipper teeth carrier, the second zipper teeth member includes a second zipper teeth carrier and a plurality of second zipper teeth disposed on the second zipper teeth carrier, and one of the first zipper teeth is retained between two of the second zipper teeth to form a gap for receiving the positioning portion.

* * * * *